US010332709B2

(12) United States Patent
Tanaka et al.

(10) Patent No.: US 10,332,709 B2
(45) Date of Patent: Jun. 25, 2019

(54) ELECTROMAGNETIC RELAY

(71) Applicant: Anden Co., Ltd., Anjo, Aichi-pref. (JP)

(72) Inventors: Tomoaki Tanaka, Anjo (JP); Makoto Kamiya, Anjo (JP); Takashi Ito, Anjo (JP)

(73) Assignee: ANDEN CO., LTD., Anjo, Aichi-pref. (JP)

( * ) Notice: Subject to any disclaimer, the term of this patent is extended or adjusted under 35 U.S.C. 154(b) by 50 days.

(21) Appl. No.: 15/510,580

(22) PCT Filed: Aug. 6, 2015

(86) PCT No.: PCT/JP2015/003955
§ 371 (c)(1),
(2) Date: Mar. 10, 2017

(87) PCT Pub. No.: WO2016/047020
PCT Pub. Date: Mar. 31, 2016

(65) Prior Publication Data

US 2017/0301497 A1 Oct. 19, 2017

(30) Foreign Application Priority Data

Sep. 25, 2014 (JP) ..... 2014-195400

(51) Int. Cl.
*H01H 9/02* (2006.01)
*H01H 50/54* (2006.01)
(Continued)

(52) U.S. Cl.
CPC ..... *H01H 50/54* (2013.01); *H01H 50/02* (2013.01); *H01H 50/14* (2013.01); *H01H 50/18* (2013.01);
(Continued)

(58) Field of Classification Search
CPC ..... H01H 50/54; H01H 50/02; H01H 50/18; H01H 50/36; H01H 50/14; H01H 33/24
(Continued)

(56) References Cited

U.S. PATENT DOCUMENTS 6,700,466 B1 * 3/2004 Yamamoto ..... H01H 9/302 218/156
8,570,125 B2 * 10/2013 Suzuki ..... H01H 50/546 335/131
(Continued)

FOREIGN PATENT DOCUMENTS

JP 2010010056 A 1/2010
JP 2012104356 A 5/2012
(Continued)

*Primary Examiner* — Shawki S Ismail
*Assistant Examiner* — Lisa N Homza
(74) *Attorney, Agent, or Firm* — Harness, Dickey & Pierce, P.L.C.

(57) ABSTRACT

An electromagnetic relay according to the present disclosure includes an excitation coil generating a magnetic field during energization, a movable core driven by the magnetic field generated by the excitation coil, a movable element including a movable contact and moving to follow the driven movable core, a plurality of stationary terminals each including a stationary contact that contacts the movable contact during the energization of the excitation coil, a stationary yoke formed of a magnetic material and supported by at least one of the plurality of stationary terminals, and a movable yoke formed of a magnetic material and arranged to face the stationary yoke, the movable yoke being in contact with the movable element and moving together with the movable element. Since the stationary yoke is supported by the stationary terminal, increase in temperature of the stationary terminal can be limited.

8 Claims, 7 Drawing Sheets

(51) Int. Cl.

| | |
|---|---|
| ***H01H 50/14*** | (2006.01) |
| ***H01H 50/02*** | (2006.01) |
| ***H01H 50/18*** | (2006.01) |
| ***H01H 50/36*** | (2006.01) |

(52) U.S. Cl.
CPC ..... *H01H 50/36* (2013.01); *H01H 2235/01* (2013.01)

(58) Field of Classification Search
USPC ..... 335/202
See application file for complete search history.

(56) References Cited

U.S. PATENT DOCUMENTS

| | | | | |
|---|---|---|---|---|
| 9,202,652 | B2 * | 12/2015 | Naka | H01H 51/22 |
| 9,412,545 | B2 * | 8/2016 | Kubono | H01H 50/60 |
| 9,564,279 | B2 * | 2/2017 | Naka | H01H 50/42 |
| 2006/0050466 | A1 * | 3/2006 | Enomoto | H01H 50/02 361/160 |
| 2009/0322453 | A1 * | 12/2009 | Kawaguchi | H01F 7/1615 335/81 |
| 2009/0322454 | A1 | 12/2009 | Tanaka et al. | |
| 2013/0335177 | A1 | 12/2013 | Enomoto | |
| 2016/0260566 | A1 * | 9/2016 | Shima | H01H 50/38 |

FOREIGN PATENT DOCUMENTS

| | | | |
|---|---|---|---|
| JP | 2012128993 | A | 7/2012 |
| JP | 2012199118 | A | 10/2012 |
| JP | 2014182943 | A | 9/2014 |

* cited by examiner

ELECTROMAGNETIC RELAY

CROSS REFERENCE TO RELATED APPLICATIONS

This application is a U.S. National Phase Application under 35 U.S.C. 371 of International Application No. PCT/JP2015/003955 filed on Aug. 6, 2015 and published in Japanese as WO 2016/047020 A1 on Mar. 31, 2016. This application is based on and claims the benefit of priority from Japanese Patent Application No. 2014-195400 filed on Sep. 25, 2014. The entire disclosures of all of the above applications are incorporated herein by reference.

TECHNICAL FIELD

The present disclosure relates to an electromagnetic relay opening or closing an electric circuit by causing a movable contact and a stationary contact to come into or out of contact with each other.

BACKGROUND ART

In a conventional electromagnetic relay, two stationary terminals having a stationary contact are positioned and fixed, and an electric circuit is opened or closed by moving a movable element having a movable contact such that the movable contact and the stationary contact come into or out of contact with each other.

An electromagnetic repulsion force (hereinafter, this electromagnetic force is referred to as a contact point electromagnetic repulsion force) is generated at a contact point of the movable contact and the stationary contact by an electric current flowing in a reverse direction in a part where the movable contact and the stationary contact face each other. The contact point electromagnetic repulsion force works such that the movable contact and the stationary contact are separated from each other.

As shown in FIG. 8, a movable yoke 93 and a stationary yoke 94 is attached to a shaft 92 which is integrated with a movable core 90 and attached to a movable element 91, the movable element 91 being interposed between the movable yoke 93 and the stationary yoke 94, and a yoke attraction force is generated between the movable yoke 93 and the stationary yoke 94 by a magnetic flux flowing in the movable yoke 93 and the stationary yoke 94 when the movable element 91 and a stationary terminal 95 contact to each other. The movable yoke 93 pushes the movable element 91 to the stationary terminal 95 so as to limit a separation of the contacts caused by the contact point electromagnetic repulsion force (for example, refer to Patent Document 1).

The movable yoke 93 is slidably attached to the shaft 92, and the stationary yoke 94 is fixed to the shaft 92. The movable element 91 and the movable yoke 93 are urged toward the stationary yoke 94 and the stationary terminal 95 by a pressure contact spring 96 attached to the shaft 92. The movable core 90 is attracted toward a stationary core 98 by an electromagnetic attraction force generated when the excitation coil 97 is energized.

When only the yoke attraction force is increased without increasing the electromagnetic attraction force in order to limit the separation caused by the contact point electromagnetic repulsion force even in a short circuit in which large amount of electric current flows, a phenomenon described below may occur.

After the movable yoke 93 is pushed the movable element 91 to the stationary terminal 95 (a situation shown in FIG. 8), the stationary yoke 94 is attracted toward the movable yoke 93 by the yoke attraction force, and the movable core 90 and the shaft 92 integrated with the stationary yoke 94 are urged in a direction opposite from the attraction force caused by the electromagnetic attraction force.

When the yoke attraction force is larger than the electromagnetic force, the movable core 90 moves apart from the stationary core 98, and accordingly the electromagnetic attraction force decreases. As a result, the contacts may be separated from each other.

When the electromagnetic force is also increased and set to be larger than the yoke attraction force, the above-described phenomenon does not occur. However, in this case, the excitation coil 97 may be large in size in order to increase the electromagnetic attraction force.

On the other hand, Patent Document 2 discloses an electromagnetic relay in which a stationary yoke is fixed to a casing. According to this, since the stationary yoke is immovable, the stationary yoke is not attracted toward the movable yoke by a yoke attraction force after the movable yoke pushes the movable element to a stationary terminal, and accordingly a separation of contacts can be limited.

However, a contact room in which the movable element and the stationary terminal are provided becomes high temperature by a heat generated by an electric current during energization or an electric arc during not energization. Since the stationary yoke is located in the contact room in the conventional electromagnetic relay disclosed in Patent Document 2, a contact point of the stationary yoke and the casing may become high temperature, and accordingly a boning power may be likely to be insufficient when the stationary yoke and the casing are bonded by a bonding agent or an adhesion tape.

Accordingly, brazing or welding is selected as a method for bonding the stationary yoke and the casing, but in this case, a positioning of the stationary yoke to the casing may be not easy.

Moreover, a resin material used for securing insulation may not resist heat of brazing.

PRIOR ART DOCUMENT

Patent Document

Patent Document 1: Japanese Patent No. 2010-10056 A
Patent Document 2: Japanese Patent No. 2012-104356 A

SUMMARY OF THE INVENTION

It is an objective of the present disclosure to provide a configuration of an electromagnetic relay in which a separation of contacts caused by a contact point electromagnetic repulsion force is limited by a yoke attraction force generated between a movable yoke and a stationary yoke, the configuration being capable of avoiding an inadequacy of a bonding power between the stationary yoke and a fixed member. Further, it is another objective to provide a configuration of the above-described electromagnetic relay capable of facilitating a positioning of the stationary yoke to the fixed member or securing an electrical insulation between a stationary terminal and the stationary yoke.

Moreover, it is another objective to provide an electromagnetic relay in which flexibility in selecting a material of a base or flexibility in design of the base around the stationary yoke can be increased.

An electromagnetic relay according to an aspect of the present disclosure includes: an excitation coil generating a magnetic field during energization; a movable core driven by the magnetic field generated by the excitation coil; a movable element including a movable contact and moving to follow the driven movable core; a plurality of stationary terminals each of which includes a stationary contact that contacts the movable contact during the energization of the excitation coil; a base including an electrical insulating resin holding the plurality of stationary terminals; a stationary yoke formed of a magnetic material and supported by at least one of the plurality of stationary terminals; and a movable yoke formed of a magnetic material and arranged to face the stationary yoke, the movable yoke being in contact with the movable element and moving together with the movable element.

According to the above-described configuration, an inadequacy of a bonding force between the stationary yoke and a fixed member can be avoided in the electromagnetic relay in which a separation of contacts caused by a contact point electromagnetic repulsion force is limited by a yoke attraction force generated between the movable yoke and the stationary yoke. Moreover, in the above-described electromagnetic relay, positioning of the stationary yoke to the fixed member can be facilitated, and an electrical insulation between the stationary terminal and the stationary yoke can be secured.

Since the stationary yoke is supported by the stationary terminal, the stationary yoke is capable of absorbing a heat generated in the stationary terminal. Accordingly, increase in temperature of the stationary terminal can be limited, and a heat resistant property required as a resign material that is used as a material of the base can be decreased. Therefore, flexibility in selection of the material of the base can be increased.

Moreover, when the stationary yoke is supported by the stationary terminal, the stationary yoke is needless to be embedded in or fixed to the base, and accordingly flexibility in design of the base around the stationary yoke.

EMBODIMENTS FOR EXPLOITATION OF THE INVENTION

Figure 1:
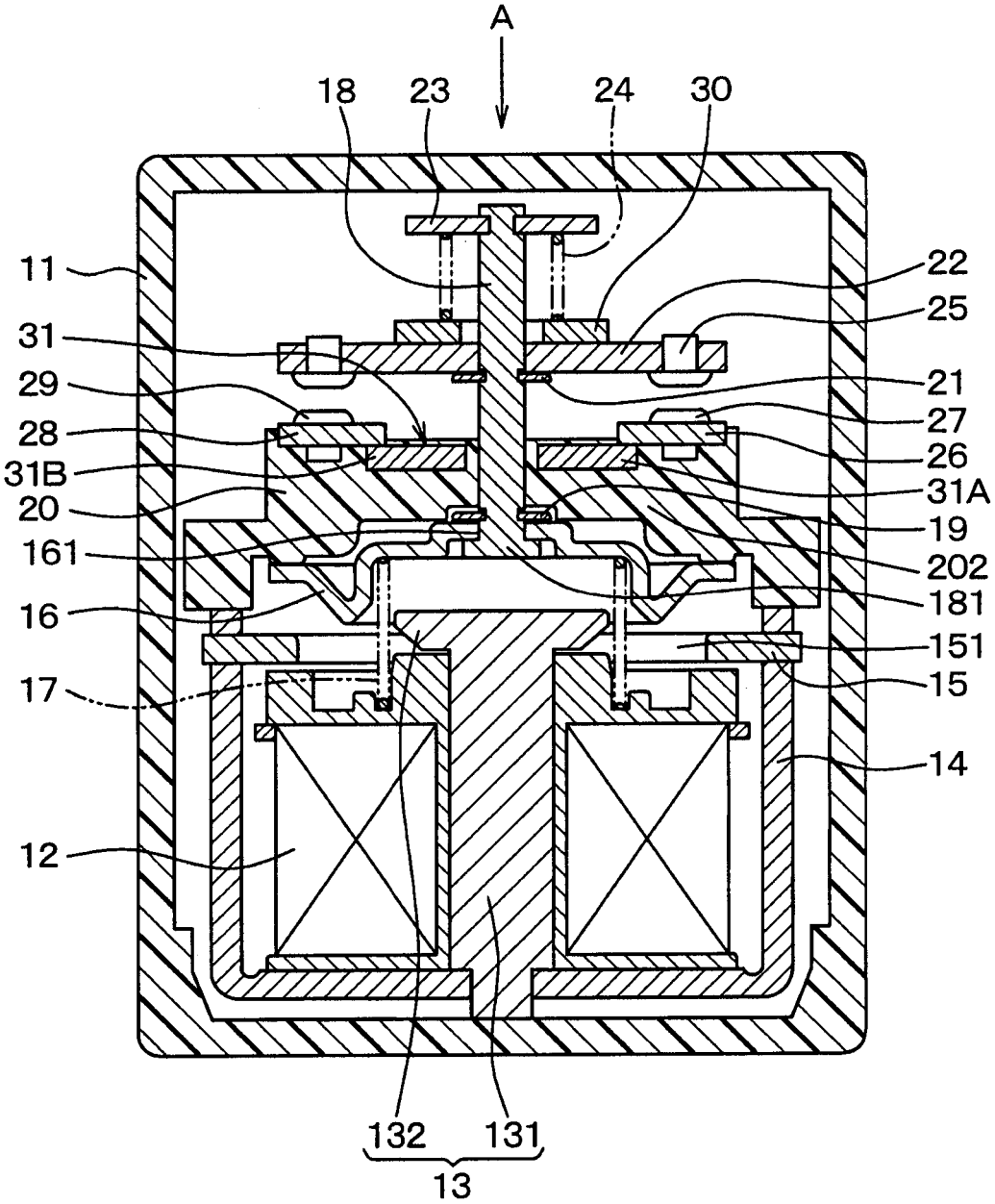
FIG. 1 is a sectional diagram illustrating an electromagnetic relay in a condition where an excitation coil is not energized, according to a first embodiment of the present disclosure.
Figure 2:
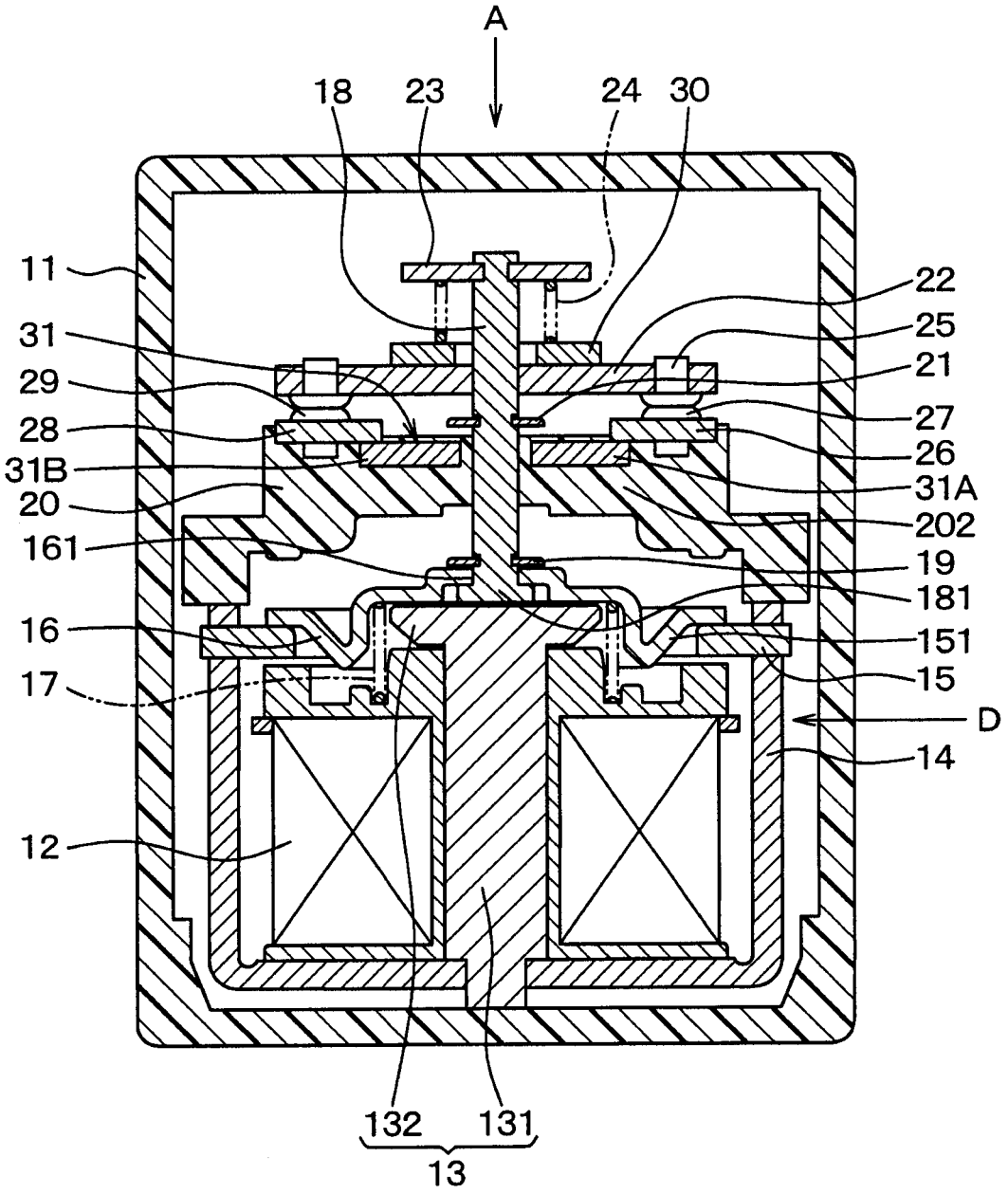
FIG. 2 is a sectional diagram illustrating the electromagnetic relay in a condition where the excitation coil is energized, according to the first embodiment.

Inventors of the present disclosure had already filed an application about a configuration which is capable of avoiding an inadequacy of a bonding force between a stationary yoke and a fixed member, facilitating positioning of the stationary yoke to the fixed member, or securing an electrical insulation between a stationary terminal and the stationary yoke in an electromagnetic relay in which a separation of contacts caused by a contact point electromagnetic repulsion force is limited by a yoke attraction force generated between a movable yoke and the stationary yoke (refer to JP 2013-056806 A).

Specifically, in order to limit the separation of contacts caused by the contact point electromagnetic repulsion force, the movable yoke is provided on a side of a movable element having a movable contact, and the stationary yoke is embedded in a base in which the stationary terminal having a stationary contact is held. According to this configuration, when an electric current flows in the movable element by connecting the movable contact and the stationary contact, a magnetic flux flows in the movable yoke and the stationary yoke, and accordingly a yoke attraction force is generated between the movable yoke and the stationary yoke. Since the movable yoke urges the movable element toward the stationary terminal by the yoke attraction force, the separation of contacts caused by the contact point electromagnetic repulsion force is limited.

However, since the stationary terminal is heated and becomes to be high temperature during an energization, it is necessary that a resin material capable of resisting the high temperature is selected, and accordingly flexibility in selection of material of the base that is formed of resin holding the stationary terminal may be decreased. Especially, since the above-described electromagnetic relay has a configuration in which the stationary yoke is fixed by the base, the stationary yoke is necessary to be embedded in or bonded to the base. Accordingly, it is necessary to secure a strength of the base, and flexibility in design of the base around the stationary yoke may be decreased.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described below. As shown in FIGS. 1 to 4C, an excitation coil 12 having a circular cylindrical shape and generating a magnetic field during an energization is disposed in a casing 11 made of resin. A stationary core 13 made of magnetic metal material is located in a hole provided in a center part of the excitation coil 12 in a radial direction. The stationary core 13 includes a core axis portion 131 having a circular column shape and being inserted into the center hole of the excitation coil 12, and a core flange portion 132 positioned outside the excitation coil 12 and having a circular column shape whose diameter is larger than a diameter of the core axis portion 131.

An outer circumference side and one end in an axial direction of the excitation coil 12 are surrounded by a second plate member 14, the second plate member 14 being a plate member made of magnetic metal material and being bent into an approximately U-shape.

The other side of the excitation coil 12 in the axial direction is surrounded by a first plate member 15, the first plate member 15 having a rectangular plate shape and made of magnetic metal material. The first plate member 15 faces a movable core 16 that is described below.

A yoke hole 151 extending through a center part of the first plate member 15 is provided, and the core flange portion 132 is provided in the yoke hole 151. The stationary core 13 and the second plate member 14 are joined to each other, and the second plate member 14 and the first plate member 15 are joined to each other.

In a position facing the core flange portion 132 and the first plate member 15, the movable core 16 having a plate shape and made of magnetic metal material is provided. The stationary core 13, the second plate member 14, the first plate member 15, and the movable core 16 make a magnetic circuit of a magnetic flux induced by the excitation coil 12.

Between the excitation coil 12 and the movable core 16, a return spring 17 urging the movable core 16 so as to depart from the stationary core 13 is provided. The movable core 16 is attracted to the stationary core 13 by an electromagnetic attraction force against the urging force of the return spring 17 when the excitation coil 12 is energized.

A shaft 18 made of metal is joined to the movable core 16. In more detail, the shaft 18 is inserted into a movable plate hole 161 provided in a center part of the movable core 16, and a shaft flange portion 181 provided on one end of the shaft 18 and a first retaining ring 19 engaged with the shaft 18 cause the movable core 16 and the shaft 18 to be joined to each other.

The movable core 16 and the shaft 18 are joined to each other across a predetermined clearance so as to be capable of moving relatively in a radial direction and an axial direction of the shaft 18. Because the clearance is provided, the movable core 16 is capable of surely contacting the first plate member 15 and the core flange portion 132 when the movable core 16 is attracted toward the stationary core 13.

A middle part of the shaft 18 is slidably inserted into a base 20 made of electrical insulating resin. A second retaining ring 21 is engaged with a part of the shaft 18 protruding from the base 20. A movable element 22, which is made of conductive metal and having a plate shape, and a movable yoke 30, which is made of a magnetic metal material and having a plate shape, are slidably attached to the part of the shaft 18 protruding from the base 20.

Two movable contacts 25 made of conductive metal are swaged and fixed to the movable element 22. The movable yoke 30 contacts the movable element 22 and moves together with the movable element 22.

A pressure contact spring 24 urging the movable element 22 and the movable yoke 30 toward the stationary core 13 (in other words, toward the second retaining ring 21) is provided between a third retaining ring 23 engaged with the other end of the shaft 18 and the movable yoke 30.

It is preferable to interpose an electrical insulating object between the pressure contact spring 24 and the movable yoke 30. The pressure contact spring 24 may push the movable element 22 in which the movable yoke 30 is fixed.

A first stationary contact 27 made of conductive metal is swaged and fixed to a first stationary terminal 26 that is made of conductive metal and has a plate shape. A second stationary contact 29 made of conductive metal is swaged and fixed to a second stationary terminal 28 that is made of conductive metal and has a plate shape.

The first stationary contact 27 is positioned to face one movable contact 25, and the second stationary contact 29 is positioned to face the other movable contact 25.

The movable element 22 and the movable contact 25 move to follow the movable core 16. Accordingly, the movable contacts 25 come into and out of contact with the first stationary contact 27 and the second stationary contact 29, and thus, the first stationary contact 27 and the second stationary contact 29 are electrically connected or shut off with each other.

A stationary yoke 31 is supported by and joined with the first stationary terminal 26 and the second stationary terminal 28 respectively. The stationary yokes 31 are plate members made of magnetic metal and are supported by welded, bonded, swaged or engaged with surfaces of the first stationary terminal 26 and the second stationary terminal 28 that is an opposite side facing the movable element 22. The stationary yokes 31 may be directly supported by the first and second stationary terminals 26, 28.

Figure 3:
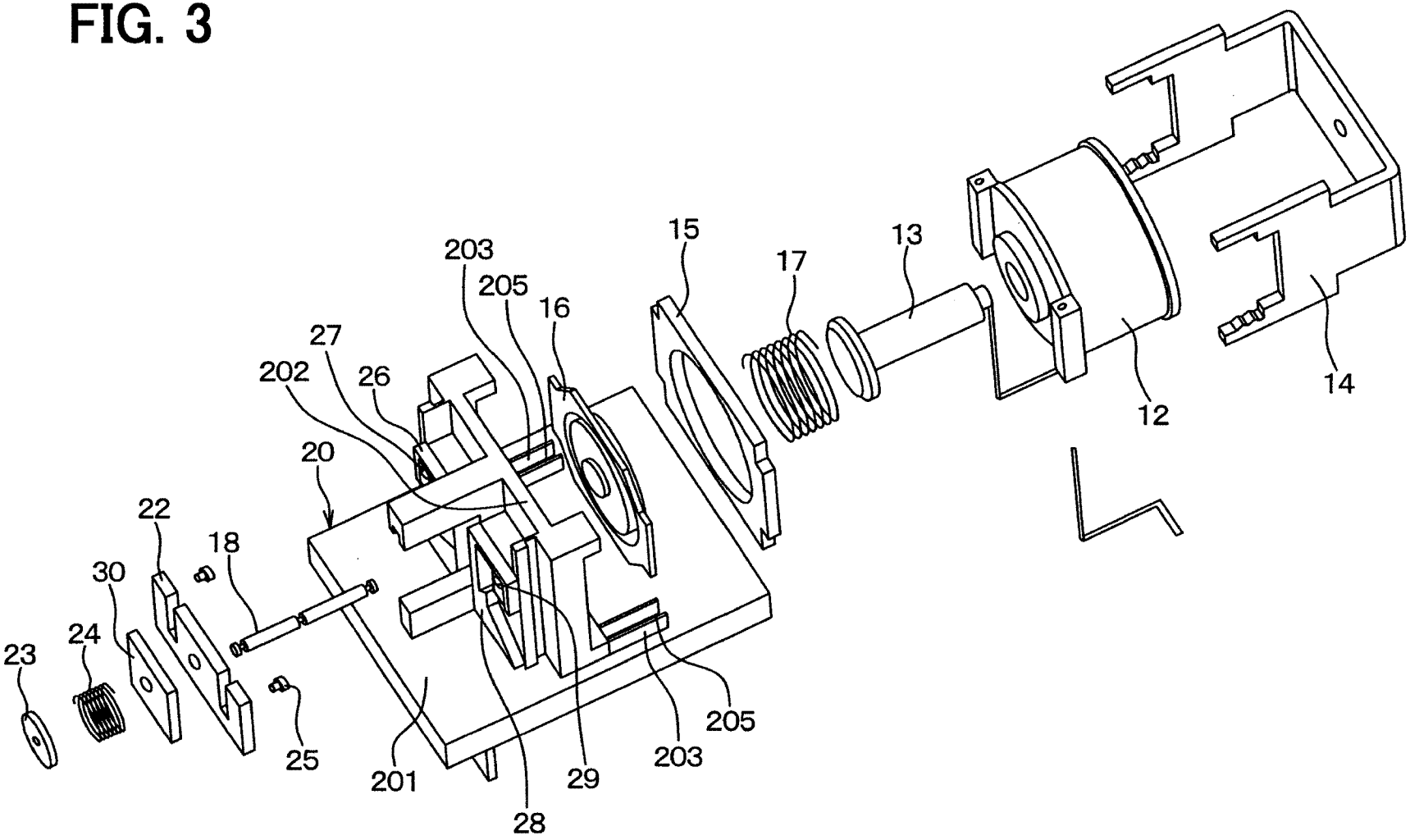
FIG. 3 is an exploded view of the electromagnetic relay according to the first embodiment.

The base 20 includes a base plate portion 201 having a flat plate shape, a first holding plate portion 202 vertical to the base plate portion 201 into which the shaft 18 is inserted, and a second holding plate portion 203 extending along a direction in which the movable core 16 moves, as shown in FIG. 3. A groove 205 into which an edge portion of the second plate member 14 is inserted is provided in the second holding plate portion 203.

The first stationary terminal 26 and the second stationary terminal 28 are held by and fixed to a surface of the first holding plate portion 202, and the stationary yoke 31 is supported by the surface of the first holding plate portion 202. The stationary yoke 31 is embedded in the first holding plate portion 202 in the present embodiment, but the stationary yoke 31 is not necessarily needed to embedded in the first holding plate portion 202 because the stationary yoke 31 is held by and fixed to the base 20 by fixing the first stationary terminal 26 and the second stationary terminal 28. The stationary terminals 26, 28 may be provided between the movable core 16 and the movable element 22.

The edge portion of the second plate member 14 is press-fitted and fixed to the groove 205, and accordingly, the second plate member 14 is integrally mounted to the base 20.

Next, the movable yoke 30 and the stationary yoke 31 are described in detail. When the excitation coil 12 is energized, the movable core 16 is attracted to the stationary core 13 by an electromagnetic attraction force, and accordingly the movable element 22 follows the movable core 16 and moves in a direction represented by an arrow A. In the description below, the direction A in which the movable element 22 moves when the excitation coil 12 is energized is referred to as a contact movement direction A. An opposite direction from the contact movement direction A is referred to as a separation movement direction.

The stationary yoke 31 is configured from a plate member having a cuboid shape, for example, a first stationary yoke 31A is supported by the first stationary terminal 26, and a second stationary yoke 31B is supported by the second stationary terminal 28. The first and second stationary yokes 31A, 31B are spaced a predetermined distance apart, and the shaft 18 is inserted therebetween. In the present embodiment, the first and second stationary yokes 31A, 31B are the same in size, but it is not necessarily needed to have the same size. When both the first stationary terminal 26 and the second stationary terminal 28 are provided, the first and second stationary yokes 31A, 31B can be provided respectively for each stationary terminal.

The stationary yoke 31 is positioned on a contact movement direction A side of the movable element 22, and at least a part of the stationary yoke 31 protrudes into a space between the first stationary terminal 26 and the second stationary terminal 28 when it is viewed along the contact movement direction A.

The movable yoke 30 is a plate member having a cuboid shape, for example, and a through hole 301 into which the shaft 18 is inserted is provided in a center part of the movable yoke 30. The movable yoke 30 is positioned on a movable element 22 side of the stationary yoke 31, and in more detail, the movable yoke 30 is positioned on an opposite side of the movable element 22 from the stationary yoke (in other words, on a separation movement direction side).

Figure 4A:
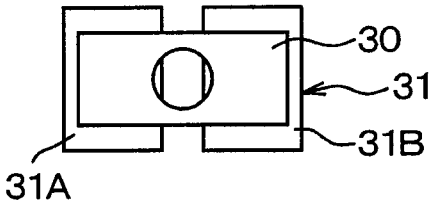
FIG. 4A is a plan view illustrating a positional relationship between a movable yoke and stationary yokes of the electromagnetic relay according to the first embodiment.
Figure 4B:
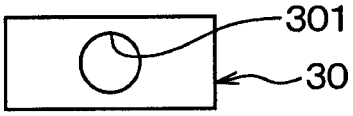
FIG. 4B is a plan view illustrating the movable yoke of the electromagnetic relay of the first embodiment.
Figure 4C:
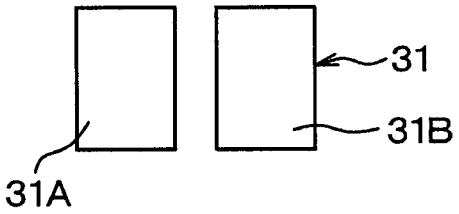
FIG. 4C is a plan view illustrating the stationary yoke of the electromagnetic relay of the first embodiment.

As shown in FIG. 4A, the movable yoke 30 and the stationary yoke 31 are arranged so as to overlap (in other words, face) each other when they are viewed along the contact movement direction A.

Next, actuations of the electromagnetic relay according to the present embodiment will be described below.

First, when the excitation coil 12 is energized, the movable core 16 is attracted toward the stationary core 13 by the electromagnetic attraction force against the return spring 17, and the shaft 18 and the movable element 22 follows the movable core 16 and moves in the contact movement direction A. Accordingly, the movable contact 25 comes into contact with the first stationary contact 27 and the second stationary contact 29, and the first stationary contact 27 and the second stationary contact 29 are electrically connected with each other (refer to FIG. 2).

Since an electric current caused by the connection between the first stationary contact 27 and the second stationary contact 29 flows in the movable element 22, a magnetic flux flows in the movable yoke 30 and the stationary yoke 31, and accordingly a yoke attraction force is generated between the movable yoke 30 and the stationary yoke 31. The movable yoke 30 urges the movable element 22 toward the first stationary terminal 26 and the second stationary terminal 28 by the yoke attraction force. Therefore, a breaking contact caused by a contact point electromagnetic repulsion force is limited by the yoke attraction force.

Since the stationary yoke 31 is not fixed to the shaft 18 and is immovable, the shaft 18, the movable element 22 and the movable core 16 is not urged in the separation movement direction by the stationary yoke 31. Accordingly, a reduction of the electromagnetic attraction force caused by a movement of the movable core 16 in a direction apart from the stationary core 13 is limited. Therefore, it is not needed to increase the electromagnetic attraction force by using a big excitation coil 12.

On the other hand, when the energization of the excitation coil 12 is stopped, the movable core 16, the shaft 18, and the movable element 22 are driven in the separation movement direction by the return spring 17. Therefore, the movable contact 25 is separated from the first stationary contact 27 and the second stationary contact 29, and the first stationary contact 27 and the second stationary contact 29 are electrically separated (refer to FIG. 1).

Since the yoke attraction force works against the return spring 17, the yoke attraction force affects a property of the electromagnetic relay when the electric current is stopped. Therefore, the yoke attraction force when the electric current is stopped is preferred to be adequately smaller than a spring force of the return spring 17.

According to the present embodiment, even when a large amount of electric current flows in short circuit, a separation of contacts caused by a contact point electromagnetic repulsion force can be surely limited without upsizing the excitation coil 12.

Since the stationary yoke 31 is supported by the first stationary terminal 26 and the second stationary terminal 28, a heat capacity of the stationary yoke 31 can be added to a heat capacity of the first stationary terminal 26 and the second stationary terminal 28 when they generate heat. Therefore, an increase of a temperature of the first stationary terminal 26 and the second stationary terminal 28 can be limited, and accordingly a heat resistant property required as a resin material that is a material of the base 20 can be decreased. Therefore, flexibility in selecting the material of the base 20 can be increased.

Moreover, since the stationary yoke 31 is supported by the first stationary terminal 26 and the second stationary terminal 28, it is not needed that the stationary yoke 31 is embedded in or bonded to the base 20, and accordingly flexibility in design of the base around the stationary yoke 31 can be increased.

Since the yoke attraction force is generated in a vicinity of an area where a contact point electromagnetic repulsion force is generated, a separation of contacts caused by a contact point electromagnetic repulsion force can be surely limited even when a spring load is not evenly put on both contacts.

Further, the stationary yoke 31 is positioned in a dead space between the first stationary terminal 26 and the second stationary terminal 28, the electromagnetic relay can be downsized.

When the stationary yoke 31 is disposed inside the base 20 made of electrical insulating resin, an electrical insulating condition between the first stationary terminal 26 and the stationary yoke 31 and between the second stationary terminal 28 and the stationary yoke 31 can be secured. Moreover, a facing area in which the stationary yoke 31 and the movable yoke 30 face each other also can be increased, and the yoke attraction force increase, and accordingly a separation of the contacts caused by a contact point electromagnetic repulsion force can be further surely limited.

Figure 5:
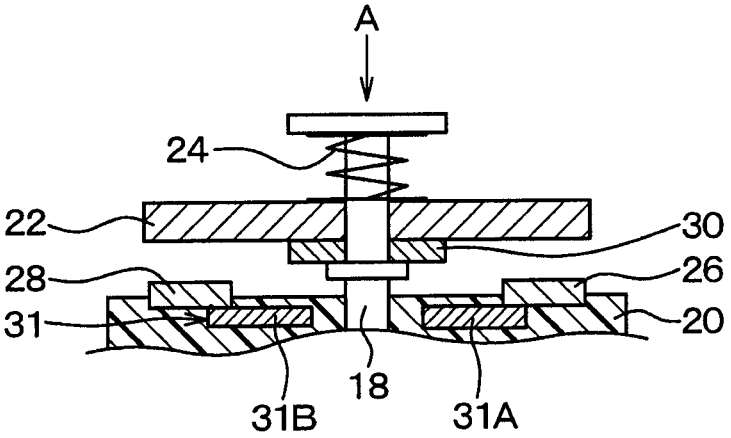
FIG. 5 is a schematic sectional diagram illustrating a part of an electromagnetic relay according to a modification of the first embodiment.

The movable yoke 30 and the stationary yoke 31 may be modified as a modification shown in FIG. 5, for example.

In the modification shown in FIG. 5, the movable yoke 30 is positioned on a stationary yoke 31 side (in other words, a contact movement direction A side) of the movable element 22. In this case, the movable yoke 30 is joined to the movable element 22 by bonding, swaging or the like.

Since the stationary yoke 31 and the movable yoke 30 are close to each other so as to increase the yoke attraction force, a separation of the contacts caused by a contact point electromagnetic repulsion force can be surely limited.

Second Embodiment

A second embodiment of the present disclosure is described below. In this embodiment, configurations of a first stationary contact 27 and a stationary yoke 31 are changed from the first embodiment, and the other configurations are the same as the first embodiment. Accordingly, only the parts different from the first embodiment are described below.

Figure 6:
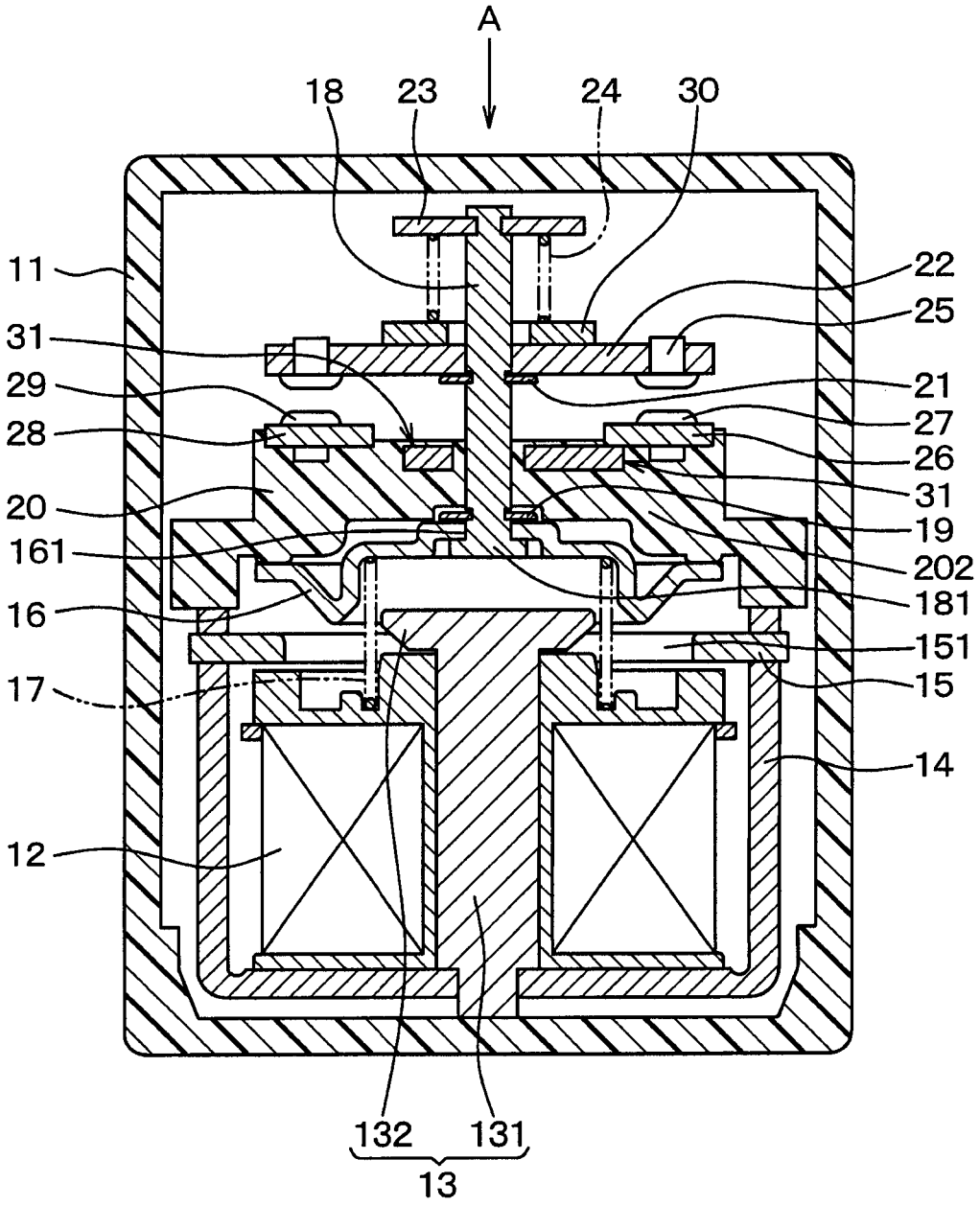
FIG. 6 is a sectional diagram illustrating an electromagnetic relay according to a second embodiment of the present disclosure.

As shown in FIG. 6, in the present embodiment, the stationary yoke 31 supported by a second stationary terminal 28 which is provided in the first embodiment is not provided, and only the stationary yoke 31 supported by a first stationary terminal 26 is provided. Since a cross section shown in FIG. 6 is a cross section including a through hole 301 into which a shaft 18 is inserted, the stationary yoke 31 is separated. However, the stationary yoke 31 is continuous in another cross section. Since the stationary yoke 31 is provided on only one side of two stationary terminals and faces a movable yoke 30 on both sides of the shaft 18, a yoke attraction force generated is balanced.

Figure 7:
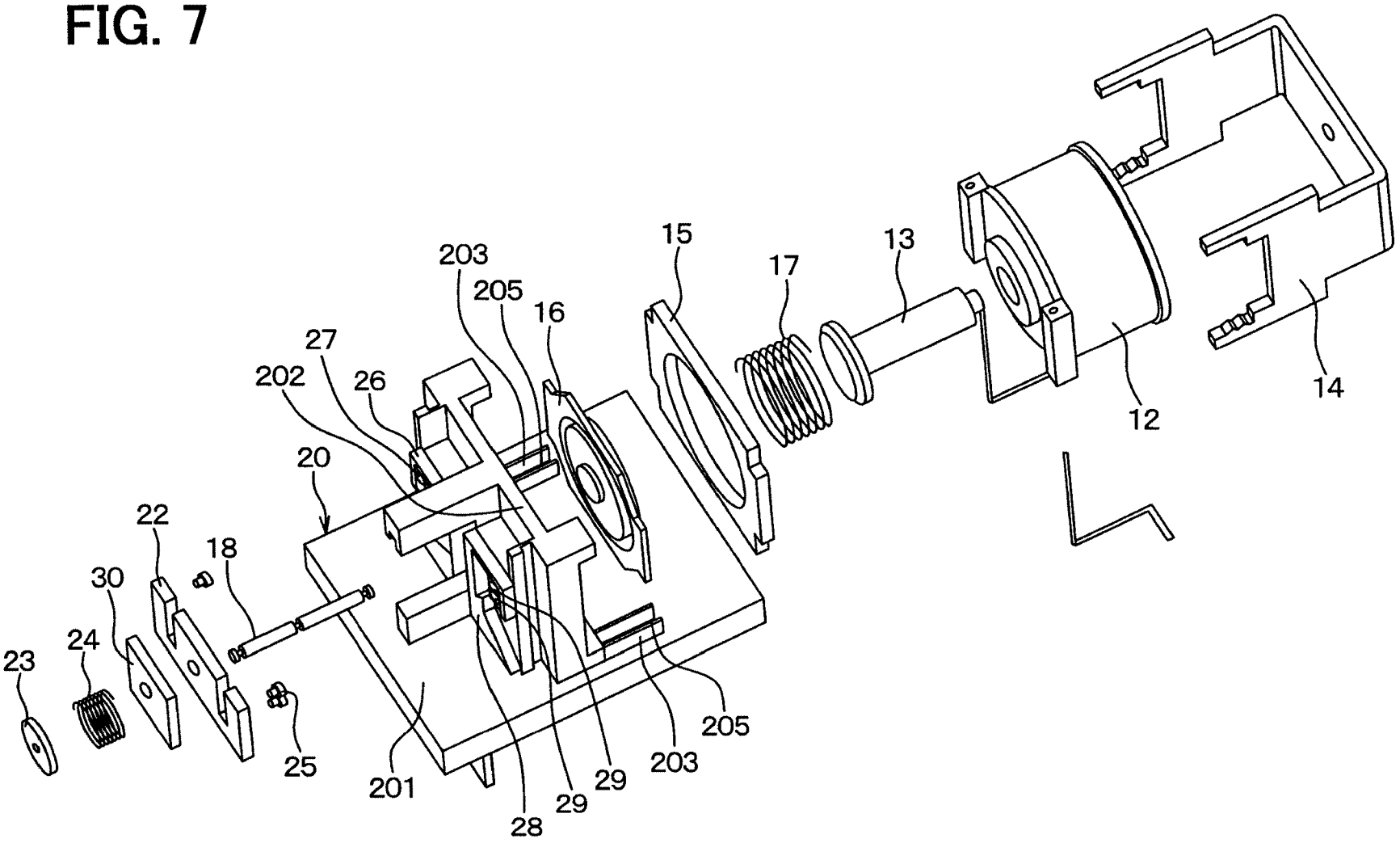
FIG. 7 is an exploded view of the electromagnetic relay according to the second embodiment.
Figure 8:
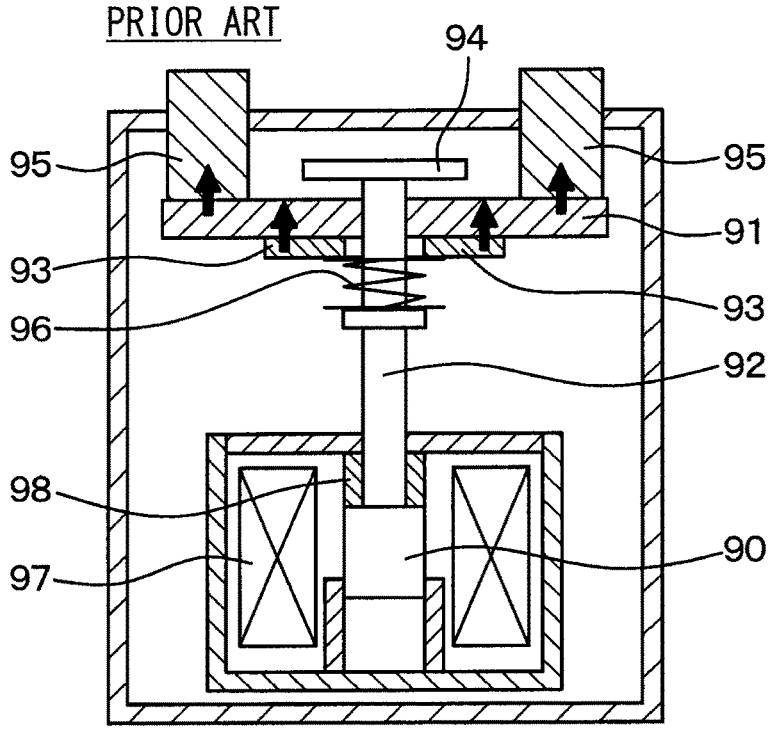
FIG. 8 is a schematic sectional diagram illustrating a conventional electromagnetic relay.
Figure 9:
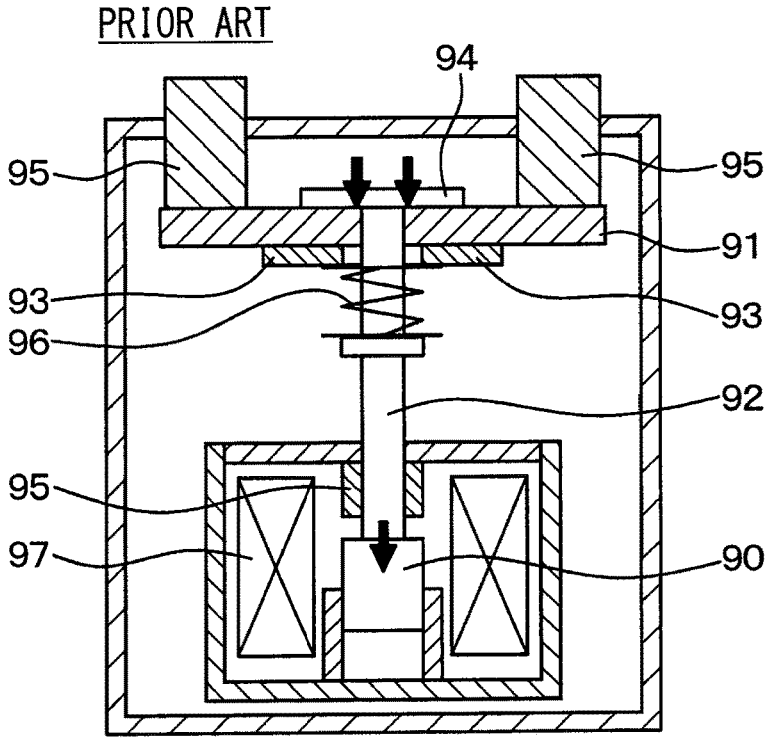
FIG. 9 is a schematic sectional diagram illustrating the conventional electromagnetic relay in a condition where an excitation coil is not energized.

As shown in FIG. 7, two second stationary contacts 29 are provided in the second stationary terminal 28, and one first stationary contact 27 is provided in the first stationary terminal 26. An electromagnetic relay according to the present embodiment is configured from the above-described configuration.

When the first and second stationary terminals 26, 28 are heated during an energization, an electric current concentrates on the terminal having a smaller number of the stationary contact, and accordingly the first stationary terminal 26 having only one first stationary contact 27 is likely to be high temperature compared to the second stationary terminal 28 having two second stationary contacts 29. Accordingly, in the present embodiment, since the stationary yoke 31 is provided only on the first stationary terminal 26 side that is likely to be high temperature, increase in a temperature of the first stationary terminal 26 can be limited by increasing a heat capacity.

Accordingly, the same effects as the first embodiment can be obtained from the configuration in which the stationary yoke 31 is provided only in one of the first and second stationary terminals 26, 28. Since the stationary yoke 31 is provided only on the first stationary terminal 26 side, a number of components can be reduced.

The present disclosure is not limited to the above-described embodiments and can be modified as described below as long as it does not depart from the spirit of the present disclosure.

In the above-described embodiment, the first stationary contact 27 is swaged to the first stationary terminal 26 that is a different component than the first stationary contact 27, and the second stationary contact 29 is swaged to the second stationary terminal 28 that is another component. However, a protrusion portion protruding toward the movable element 22 may be provided by stamping, and the protrusion portion may be used as the stationary contact. The stationary contacts 27, 29 may be seamlessly integrated with the stationary terminals 26, 28.

In the above-described embodiment, the movable contact 25 is swaged to the movable element 22 that is a different component than the movable contact 25. However, a protrusion portion protruding toward the first stationary terminal 26 and the second stationary terminal 28 may be provided by stamping, and the protrusion portion may be used as the movable contact. The movable contact 25 may be seamlessly integrated with the movable element.

In the first embodiment, the movable yoke 30 is provided as a single component having the through hole 301 in its center part, but the movable yoke 30 may be provided as two components arranged to face the first and second stationary contact 27, 29 respectively.

The present disclosure is not limited to the above described embodiments and can be arbitrarily modified.

In the above-described embodiments, it is needless to say that components of the embodiments are not essential excepting a case where the component is apparently essential in principle or it is explicitly described to be essential.

In the above-described embodiments, when the number, numerical value, quantity, numerical ranges, etc. of components are mentioned, it is not intended to be limited to the particular number excepting a case where the component is apparently limited to the particular number in principle or it is explicitly described to be essential.

Although the present disclosure is described in connection with the embodiments, the present disclosure is not limited to the embodiments of its configurations. The present disclosure includes various modifications or changes within its equivalence. Moreover, various combinations of embodiments.

The invention claimed is:

1. An electromagnetic relay comprising:

an excitation coil generating a magnetic field during energization;

a movable core driven by the magnetic field generated by the excitation coil;

a movable element including a movable contact and moving to follow the driven movable core;

a plurality of stationary terminals each of which includes a stationary contact that contacts the movable contact during the energization of the excitation coil;

a base including an electrical insulating resin holding the plurality of stationary terminals;

a stationary yoke formed of a magnetic material and supported by at least one of the plurality of stationary terminals; and a movable yoke formed of a magnetic material and arranged to face the stationary yoke, the movable yoke being in contact with the movable element and moving together with the movable element, wherein the stationary terminal is located between the movable core and the movable element.

2. The electromagnetic relay according to claim 1, wherein a direction in which the movable element moves during the energization of the excitation coil is a contact movement direction; and a part of the stationary yoke protrudes into a space between the plurality of stationary terminals when the stationary yoke is viewed along the contact movement direction.

3. The electromagnetic relay according to claim 1, wherein the plurality of stationary terminals includes a first stationary terminal and a second stationary terminal;

the stationary yoke includes a first stationary yoke and a second stationary yoke;

the first stationary yoke is supported by the first stationary terminal; and the second stationary yoke is supported by the second stationary terminal.

4. The electromagnetic relay according to claim 1, wherein the plurality of stationary terminals includes a first stationary terminal and a second stationary terminal;

the stationary contact of the first stationary terminal is a single first stationary contact;

the stationary contacts of the second stationary terminal are two second stationary contacts; and the stationary yoke is supported by the first stationary terminal.

5. The electromagnetic relay according to claim 1, wherein the stationary contact is integrated with the plurality of stationary terminals.

6. An electromagnetic relay comprising:

an excitation coil generating a magnetic field during energization;

a movable core driven by the magnetic field generated by the excitation coil;

a movable element including a movable contact and moving to follow the driven movable core;

a plurality of stationary terminals each of which includes a stationary contact that contacts the movable contact during the energization of the excitation coil;

a base including an electrical insulating resin holding the plurality of stationary terminals;

a stationary yoke formed of a magnetic material and supported by at least one of the plurality of stationary terminals; and a movable yoke formed of a magnetic material and arranged to face the stationary yoke, the movable yoke being in contact with the movable element and moving together with the movable element, wherein a direction in which the movable element moves during the energization of the excitation coil is a contact movement direction;

a part of the stationary yoke protrudes into a space between the plurality of stationary terminals when the stationary yoke is viewed along the contact movement direction, the stationary yoke has a plate shape, and the stationary terminal is located between the movable element and the stationary yoke in the contact movement direction.

7. The electromagnetic relay according to claim 6, wherein the stationary contact is integrated with the plurality of stationary terminals.

8. The electromagnetic relay according to claim 6, wherein the stationary terminal is located between the movable core and the movable element.

* * * * *